US010295258B2

(12) United States Patent
Durham

(10) Patent No.: US 10,295,258 B2
(45) Date of Patent: May 21, 2019

(54) SPORTS EQUIPMENT RACK

(71) Applicant: Daniel L. Durham, Fremont, MI (US)

(72) Inventor: Daniel L. Durham, Fremont, MI (US)

( * ) Notice: Subject to any disclaimer, the term of this patent is extended or adjusted under 35 U.S.C. 154(b) by 308 days.

(21) Appl. No.: 13/788,116

(22) Filed: Mar. 7, 2013

(65) Prior Publication Data

US 2013/0180124 A1 Jul. 18, 2013

Related U.S. Application Data

(63) Continuation of application No. 12/832,537, filed on Jul. 8, 2010, now Pat. No. 8,393,482, which is a continuation of application No. 10/940,132, filed on Sep. 14, 2004, now abandoned.

(51) Int. Cl.

| | |
|---|---|
| ***A47L 23/20*** | (2006.01) |
| ***D06F 59/02*** | (2006.01) |
| ***F26B 25/06*** | (2006.01) |

(52) U.S. Cl.

CPC ..... *F26B 25/06* (2013.01); *A47L 23/205* (2013.01); *D06F 59/02* (2013.01)

(58) Field of Classification Search

USPC ... 211/13, 182, 189, 196, 205, 33, 193, 85.7
See application file for complete search history.

(56) References Cited

U.S. PATENT DOCUMENTS

| | | | | |
|---|---|---|---|---|
| 863,820 | A | | 8/1907 | Wingert |
| 1,409,852 | A | | 3/1922 | Harvey |
| 1,804,069 | A | | 5/1931 | Stover |
| 2,882,666 | A | | 4/1959 | Cochrane |
| 3,100,128 | A | | 8/1963 | Gleitsman et al. |
| 3,513,564 | A | | 5/1970 | Gramprie |
| 3,645,009 | A | * | 2/1972 | Ketchum ..... 34/104 |
| 3,798,788 | A | | 3/1974 | Kuntz |
| 4,200,993 | A | | 5/1980 | Blanc et al. |
| 4,351,441 | A | | 9/1982 | Schramm |
| 4,792,071 | A | | 12/1988 | Scarpa et al. |
| D301,094 | S | | 5/1989 | Muxlow |
| 5,199,188 | A | | 4/1993 | Franz |
| 5,222,308 | A | | 6/1993 | Barker et al. |
| 5,287,636 | A | | 2/1994 | Lafleur et al. |
| 5,377,849 | A | | 1/1995 | Martin |
| 5,412,928 | A | | 5/1995 | Reithel |

(Continued)

FOREIGN PATENT DOCUMENTS

| | | |
|---|---|---|
| WO | 9412068 | 6/1994 |

*Primary Examiner* — Lindsay M Maguire
(74) *Attorney, Agent, or Firm* — James E. Shultz, Jr.

(57) ABSTRACT

An improved sports equipment frame includes frame having a main vertical member including an upper end and a lower end, and a plurality of extensions projecting laterally from the main vertical member; and a bowed hanger extending from the main vertical member for draping an article of clothing, the hanger elevationally located between the upper and lower ends of the vertical member. In a preferred embodiment, the sports equipment rack includes pant leg restrainers for suppressing movement of the legs of pants during spray washing, and a headgear support plate having a generally flat upper surface that is larger than the cross sectional area of the vertical member. The sports equipment rack is lightweight, compact and portable, and is suitable for storing, organizing, washing and drying various types of sporting equipment and clothing.

15 Claims, 6 Drawing Sheets

(56) References Cited

U.S. PATENT DOCUMENTS

| | | | |
|---|---|---|---|
| D361,444 | S | 8/1995 | Egan |
| 5,509,545 | A | 4/1996 | Banke |
| 5,592,750 | A | 1/1997 | Eichten |
| 6,116,437 | A | 9/2000 | Rowe |
| 6,176,400 | B1 | 1/2001 | Lam |
| 6,327,792 | B1 | 12/2001 | Hebert |
| 6,553,687 | B1 | 4/2003 | Leamon, Jr. |
| 2002/0144961 | A1 | 10/2002 | McNab |
| 2003/0102414 | A1 | 6/2003 | Smart |
| 2003/0222038 | A1 | 12/2003 | Collier |
| 2004/0068888 | A1 | 4/2004 | Lurie |

* cited by examiner

SPORTS EQUIPMENT RACK

CROSS-REFERENCE TO RELATED APPLICATIONS

This application is a continuation of U.S. patent application Ser. No. 10/940,132 titled SPORTS EQUIPMENT RACK, which was filed on Sep. 14, 2004, and is now abandoned, and which is a continuation of U.S. patent application Ser. No. 12/832,537, which was filed on Jul. 8, 2010, which is pending and incorporated herein in its entirety.

FIELD OF THE INVENTION

This invention described herein relates to equipment and clothing racks, and more particularly to a sports equipment rack suitable for supporting sporting clothing and/or equipment for storage, washing and/or drying.

BACKGROUND OF THE INVENTION

Various devices have been developed for supporting, washing and/or drying clothing and/or sporting equipment. However, many of these devices lack portability, in the sense that they cannot be easily carried and loaded into a vehicle. For example, various drying racks for shoes, boots, clothing and the like, include large, heavy frames with wheels or castors that allow the rack to be wheeled around on a floor within a building, but which are too large and unwieldy to be loaded into a typical non-commercial vehicle. Many of the more portable devices are only suitable for drying particular items, such as a helmet or shoes, and cannot be easily used for simultaneously supporting a complete set of sporting clothing and equipment.

In certain sports, such as cross country motorcycle racing, it is often desirable to be able to wash and dry a complete set of equipment and clothing, including boots, helmet, trousers, jersey, pads, gloves, etc., between races. Known sports equipment racks and various related drying apparatuses have not been particularly well suited for washing and drying such equipment at remote locations due to their lack of portability and/or limited ability to support a complete set of sporting equipment and clothing.

U.S. Pat. No. 5,377,849 discloses a sports equipment rack for supporting various sports equipment, particularly hockey and football equipment. The device comprises straight, right angle, and obtuse angle tubular pieces that are connected together to form an equipment rack that is said to minimize the amount of floor space required, yet allow arrangement of the equipment and/or clothing to facilitate drying in as short a time as possible. However, the device does not include an integral hanger for supporting a jersey, jacket or trousers, but instead includes a helmet support that may be used to support a hanger for a jersey or pants on the backside of the rack. This arrangement is not particularly well suited for washing or drying trousers or jerseys. Further, the device does not facilitate rapid drying, but instead relies on gravity (drip drying) and natural air drying, and therefore is not particularly useful for washing and drying between events occurring on the same day.

Unites States Patent Application Publication 2003/0222038 discloses a storage rack for athletic equipment and clothing having air flow apertures on each of various appendages which communicate with a common air chamber held at superatmospheric pressure by a heated air blower. However, the device does not include an integral hanger for supporting trousers, a jersey or a jacket, but instead has eyelets for supporting a removable hanger. This arrangement is not particularly conducive to washing or drying of trousers, jerseys or the like.

There is a need for an improved sports clothing/equipment rack that is easily transportable by hand, and which can be easily loaded in a vehicle for use at a remote location for washing and/or drying a full set of sporting equipment and clothing, including headgear, trousers, jersey, gloves, footwear, pads, etc.

SUMMARY OF THE INVENTION

There is provided an improved sports equipment rack that is easily transported by hand, and which facilitates washing and drying of a full set of sporting equipment and clothing, including headgear, trousers, jersey, footwear, gloves, pads, etc., at a remote location.

In accordance with an aspect of this invention, the sports equipment rack comprises a frame including a main vertical member having an upper end and a lower end, and a plurality of extensions projecting laterally from the main vertical member; and a hanger having bowed shoulders extending from the main vertical member for a torso-covering article of clothing, the hanger elevationally located between the upper and lower ends of the vertical member. This arrangement allows trouser and/or a jersey to be supported in manner that facilitates rapid washing and drying of the jersey and/or trousers.

These and other features, advantages and objects of the invention will be further understood and appreciated by reference to the following specification, claims and appended drawings.

DETAILED DESCRIPTION OF EMBODIMENTS

Figure 1:
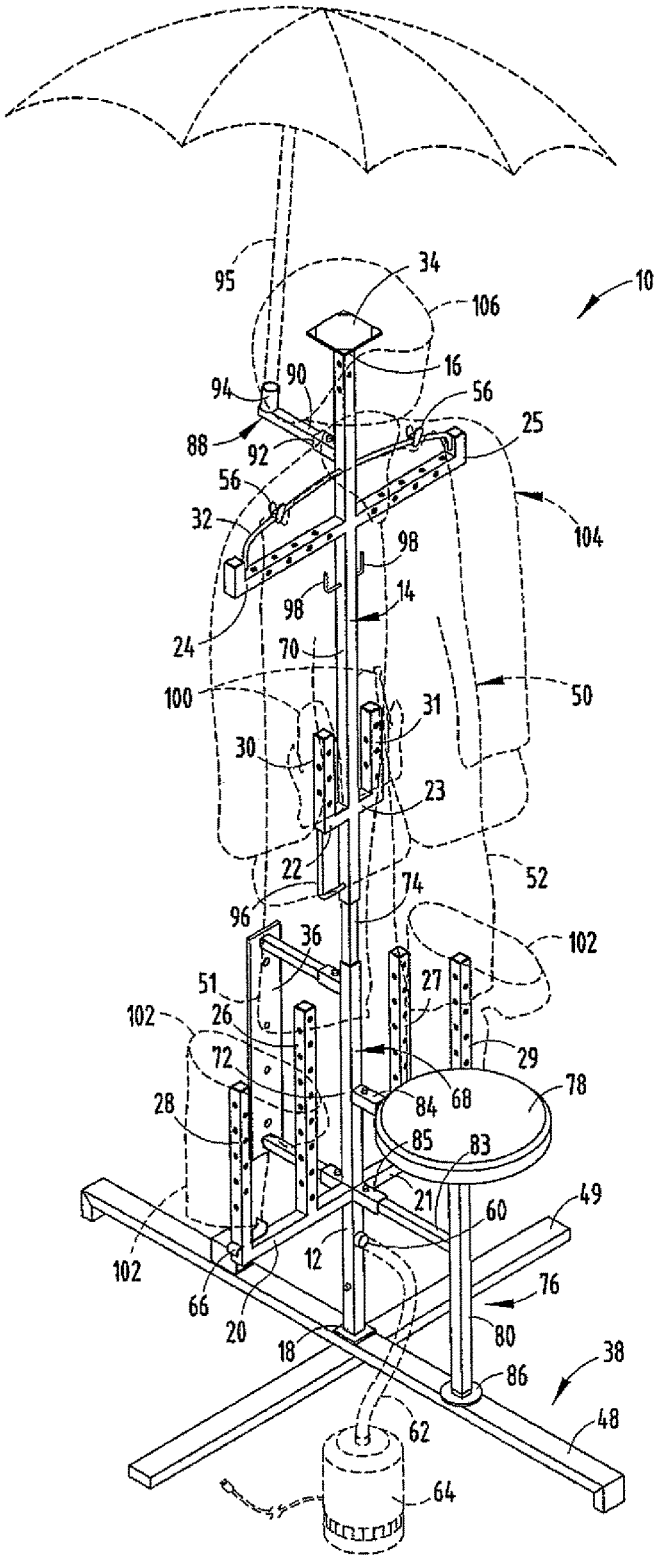
FIG. 1 is a perspective view of a sports equipment rack for supporting sporting equipment and/or clothing for storage, washing and/or drying.

In FIG. 1, there is shown an embodiment of a sports equipment rack 10 in accordance with the invention. Sports equipment rack 10 includes a frame 12 having a main vertical member 14 with an upper end 16 and a lower end 18, and a plurality of extension projecting laterally from the main vertical member. The lateral extensions of the illustrated sports equipment rack 10 include boot/trouser-retainer extensions 20 and 21, glove extensions 22 and 23, and hanger extensions 24 and 25. Extending upwardly from boot/trouser-retainer extensions 20, 21 are trouser leg restrainers 26 and 27, and boot/footwear supports 28 and 29. Extending upwardly from glove extensions 22, 23 are glove supports 30 and 31. Extending from main vertical member 14 is a bow-shaped hanger 32. Attached onto and supported solely by upper end 16 of vertical member 14 is a headgear support plate 34.

Sports equipment rack 10 is designed to be mounted either to a wall using a wall mount 36, or on a foldable base 38. Thus, the illustrated embodiment is provided with lateral extensions 40, 41 that are adapted for quick connection to lateral members 42 and 43, respectively, projecting from base plate 44 of wall mount 36. Preferably, extensions 40, 41 and lateral members 42, 43 are provided with cooperating quick-connect mechanisms that allow frame 12 to be quickly and easily attached to wall mount 36 and quickly removed when desired. Desirably, base plate 44 of wall mount 36 is provided with fastener apertures that allow wall mount 36 to be securely fastened (such as which screws) to a sturdy member (e.g., stud) of a wall.

Figure 5:
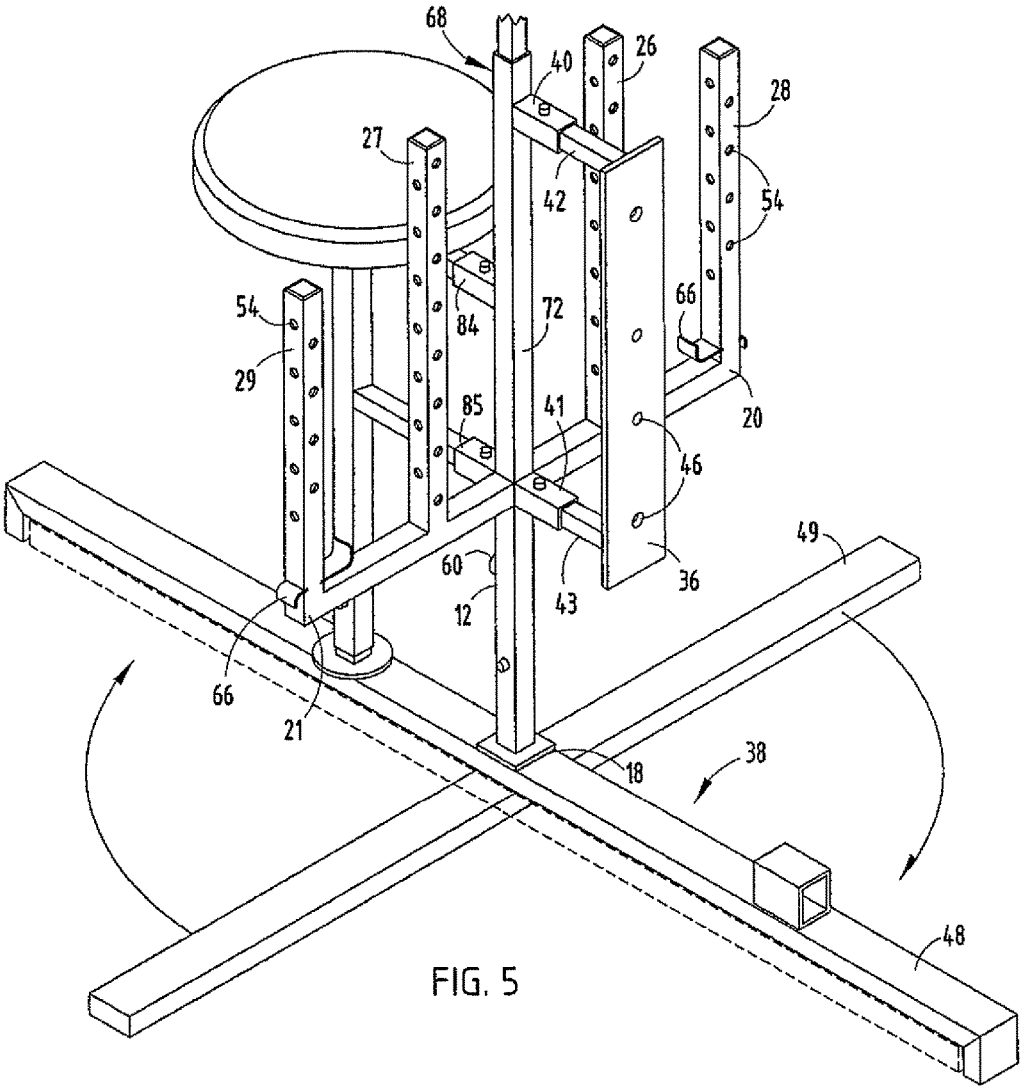
FIG. 5 is a fragmented, enlarged perspective view of the lower section of the sports equipment rack shown in FIG. 1.

A quick-release/quick-connect mechanism may be provided to allow lower end 18 of main vertical member 14 to be easily attached to and removed from foldable base 38. As shown in FIG. 5, foldable base 38 comprises two elongate members, including an upper base member 48 and a lower base member 49. Lower base member 49 is attached to upper base member 48 so that lower base member 49 can be rotated (as shown in FIG. 5), from the position shown in which members 48, 49 form a highly stable cross configuration, by 90 degrees into a configuration in which lower base member 49 is parallel to and located completely under upper base member 48. Upper base member 48 is provided with a lug for attaching frame 12 to foldable base 38 to facilitate transportation and storage of foldable base 38 and frame 12 together.

Sports equipment rack 10 is designed to support sporting equipment and clothing in a manner and orientation resembling the manner and orientation in which the sporting equipment and clothing are worn by a sportsman. This arrangement has many advantages. The arrangement allows the sportsman to quickly ascertain whether all of the equipment is present and in good condition. The arrangement also facilitates dressing or suiting up by presenting all of the equipment and clothing in an organized fashion. Another important advantage is that the configuration of the sports equipment rack 10 presents surfaces of the equipment and clothing in a manner resembling the manner in which such surfaces are presented on the sportsman, thereby facilitating washing of all surfaces of the equipment and clothing. Specifically, sports equipment rack 10 is configured with headgear support plate 34 attached at upper end 16 of main vertical member 14, and with the footwear supports 28, 29 and trouser leg restrainers 26, 27 near the base or lower end 18 of sports equipment rack 10. Hanger 32 is vertically located directly underneath headgear support plate 34, and spaced sufficiently above trouser leg restrainers 26, 27 to allow a pair of trousers 50 (shown in dashed lines in FIG. 1) to be suspended from hanger 32 with pant legs 51, 52 extending over trouser leg restrainers 26, 27. This serves two functions. First, in all embodiments, restrainers 26, 27 prevent trousers 50 from moving while being washed, such as during spraying with a hose. In certain embodiments, trouser leg restrainers 26, 27 are provided with a plurality of apertures from which heated air flows from the interior of frame 12 onto and up the legs of trousers 50.

Figure 4:
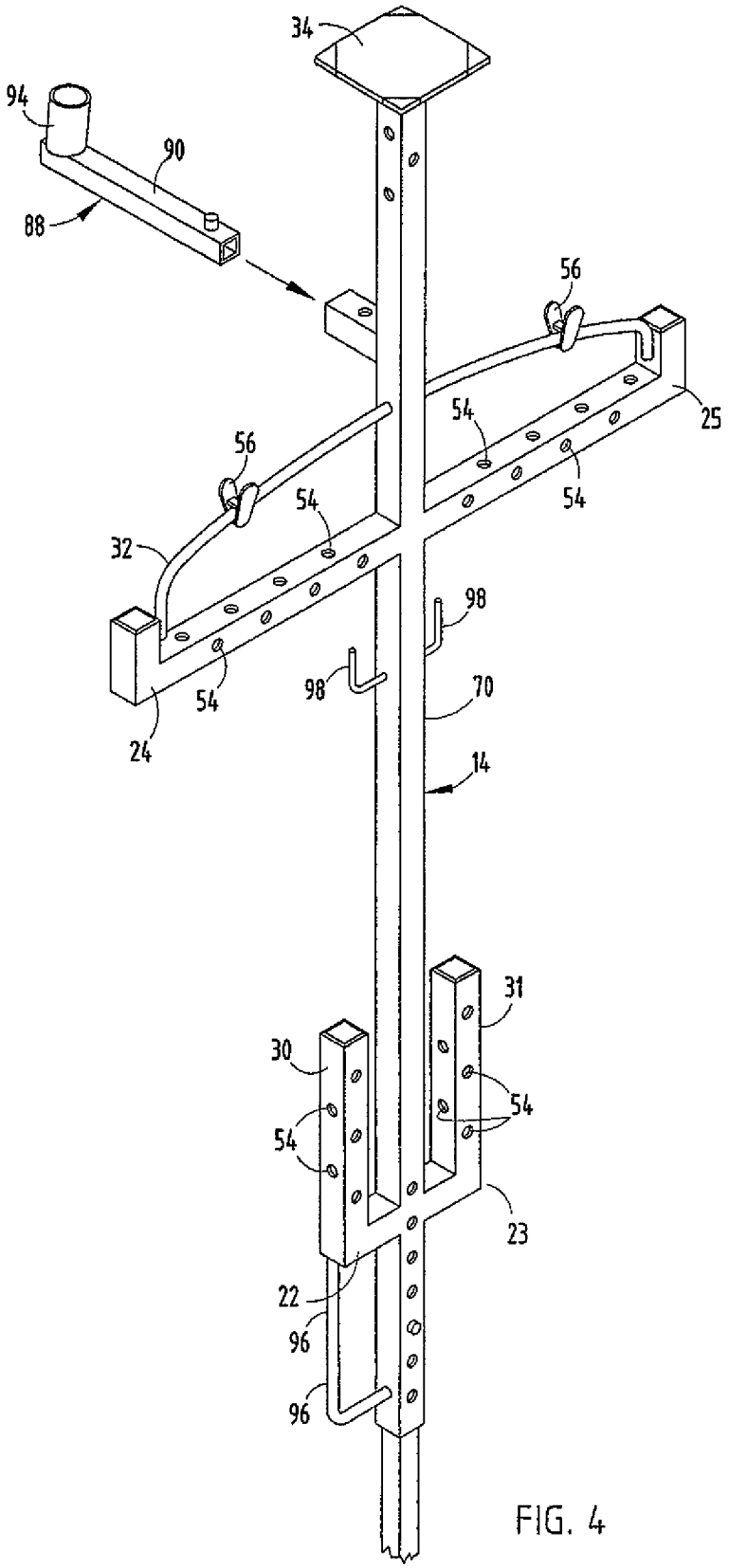
FIG. 4 is a fragmented, enlarged perspective view of an upper section of the sports equipment rack shown in FIG. 1.

Referring to FIG. 4, hanger 32 may be provided with a pair of clips 56 from which a pair of trousers may be suspended at the waist. Preferably, trouser leg restrainers 26, 27 are located under hanger 32 so that pant legs 51, 52 of trousers 50 suspended from hanger 32 can be positioned over trouser leg restrainers 26, 27 to suppress movement of pant legs 51, 52, such as during spray washing or air drying in the wind.

Figure 4A:
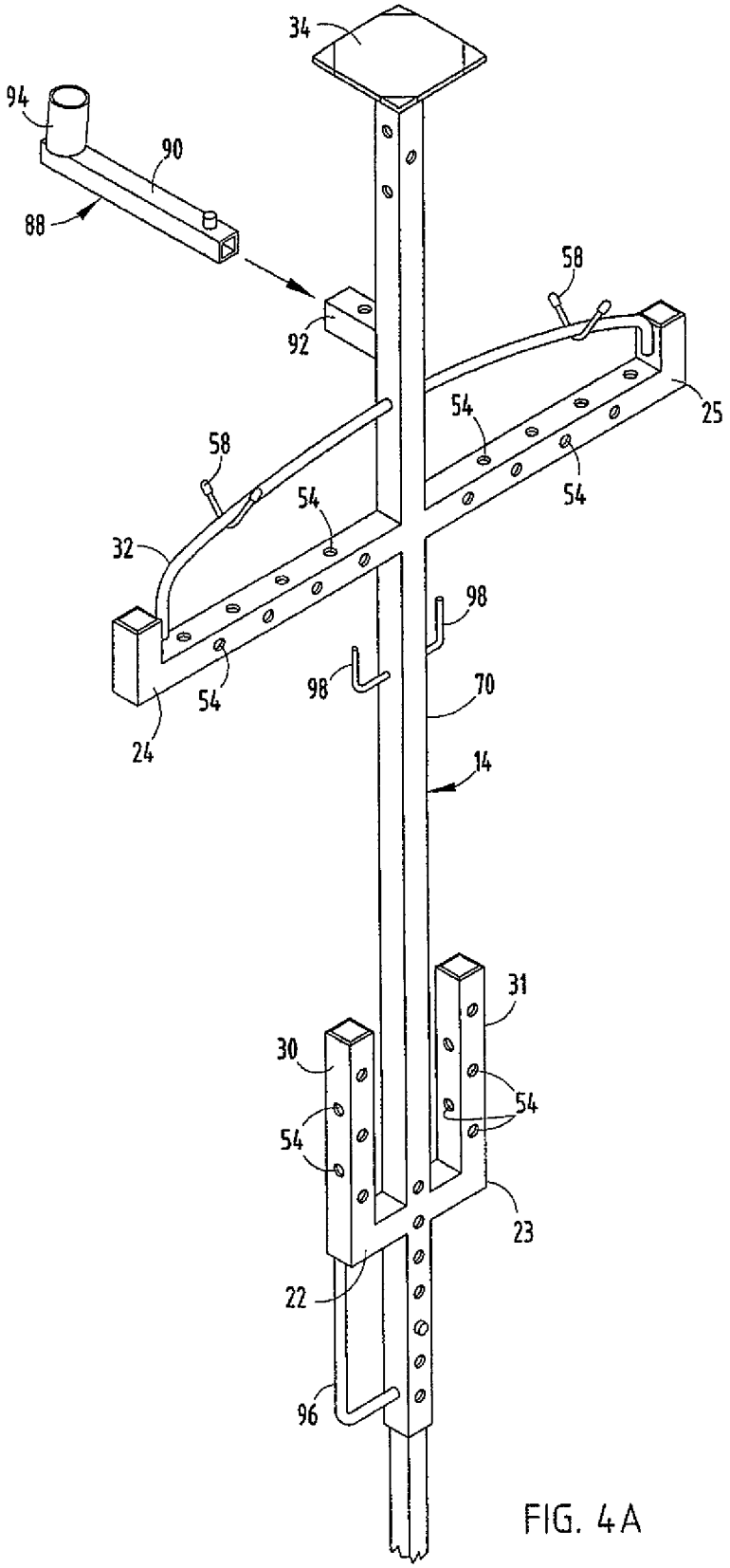
FIG. 4A is a fragmented, enlarged perspective view of the upper section of an alternative embodiment of a sports equipment rack in accordance with the invention.

In an alternative embodiment shown in FIG. 4A, upwardly projecting prongs 58 extend from hanger 32 to provide a means by which a pair of trousers may be suspended from hanger 32 by placing belt loops of the trousers over prongs 58.

In accordance with certain preferred embodiments of the invention, main vertical member 14, boot/trouser restrainer extensions 20, 21, glove extensions 22, 23, hanger extensions 24, 25, trouser leg restrainers 26, 27, boot/footwear supports 28, 29 and glove supports 30, 31 are tubular members that define conduits in fluid communication with each other for conveying heated air from an inlet port 60 through the various conduit members of frame 12 and out of a plurality of apertures 54 provided through walls of main vertical member 14, lateral hanger extensions 24, 25, trouser leg restrainers 26, 27, boot/footwear supports 28, 29 and glove supports 30, 31. Specifically, heated air may be directed through the apertures at upper end 16 of main vertical member 14 to facilitate rapid drying of a helmet of other headgear supported on headgear support plate 34, from the apertures through the walls of hanger extensions 24, 25 onto a jersey, jacket of the like supported on hanger 32, from the apertures through the walls of trouser leg restrainers 26, 27 to facilitate rapid drying of trousers 50, through the apertures defined in the walls of boot/footwear supports 28, 29 to facilitate rapid drying of boots or other footwear, and through the apertures defined in the walls of glove supports 30, 31 to facilitate rapid drying of gloves or mittens.

Preferably, inlet air port 60, may be provided with a quick-connect/disconnect coupling to facilitate quick connection to a flexible hose 62 for conveying heated air from a blow dryer 64 into frame 12 through inlet air port 60.

Figure 6:
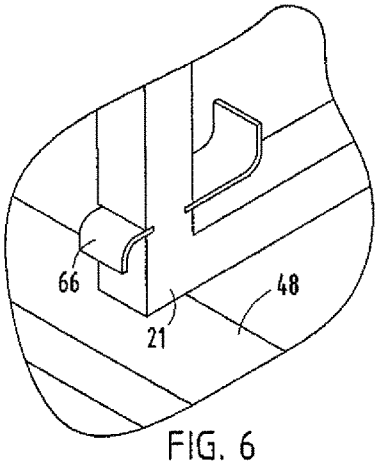
FIGS. 6 and 7 are enlarged perspective views showing a valve arrangement for the boot/footwear supports of the sports equipment rack shown in FIG. 1.
Figure 7:
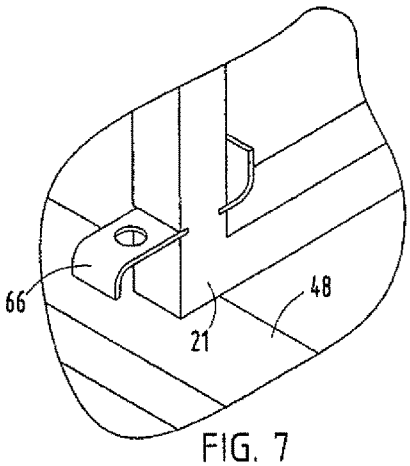

In the illustrated embodiment (see details in FIGS. 6 and 7) a valve mechanism 66 is provided on boot/footwear supports 28, 29 to either allow air to flow out of the apertures in boot/footwear supports 28, 29 as shown in FIG. 6, or block off the flow of air through the apertures in boot/footwear supports 28, 29 as shown in FIG. 7. This feature allows air flow to be limited as desired to concentrate heated air flow through those apertures where it is needed. For example, in the event that a sportsman wishes to dry a jersey or jacket and a pair of trousers, but does not need to dry any footwear, valves 66 may be closed to cause more air to flow through the apertures defined in the walls of trouser leg restrainers 26, 27, glove supports 30, 31, main vertical member 14 (near the headgear support plate), and hanger extensions 24, 25. Although the illustrated embodiment includes valve mechanism 66, on boot/footwear supports 28, 29, it is conceivable that similar valve mechanisms may be employed for the apertures near the upper end 16 of frame 12 in the event that it is not necessary to dry a helmet or any other headgear. Similarly, such valve mechanisms may also be provided on hanger extensions 24, 25, glove supports, 30, 31 and/or trouser leg restrainers 26, 27, to limit flow of heated air for drying as needed or desired. The telescopic sections 68, 70 and height adjustment locking mechanisms are designed to maintain a substantially leak proof or leak resistant conduit for conveying air from blower 64 to apertures 54 regardless of the height adjustment.

Figure 2:
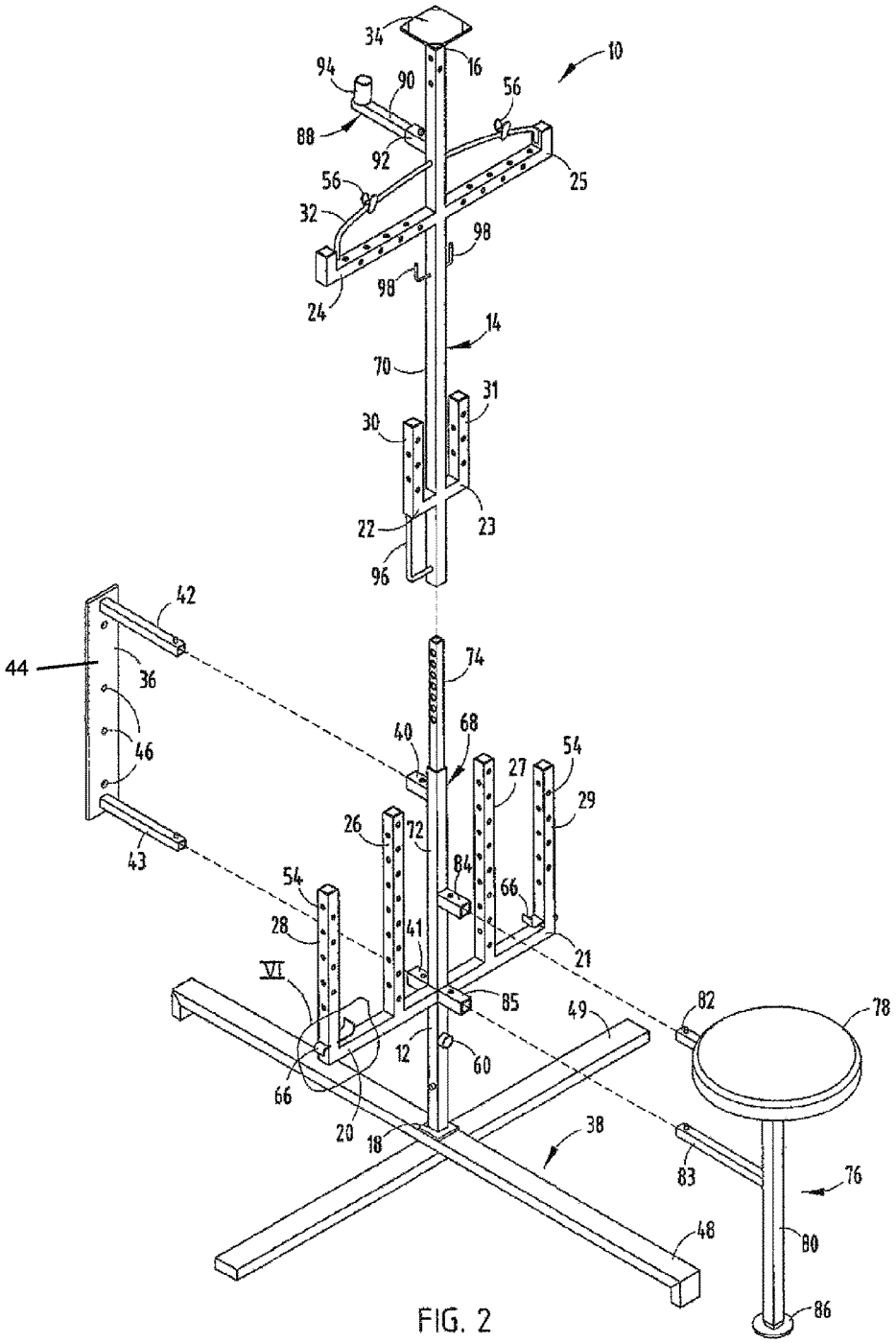
FIG. 2 is an exploded perspective view illustrating assembly and disassembly of the sports equipment rack shown in FIG. 1.
Figure 3:
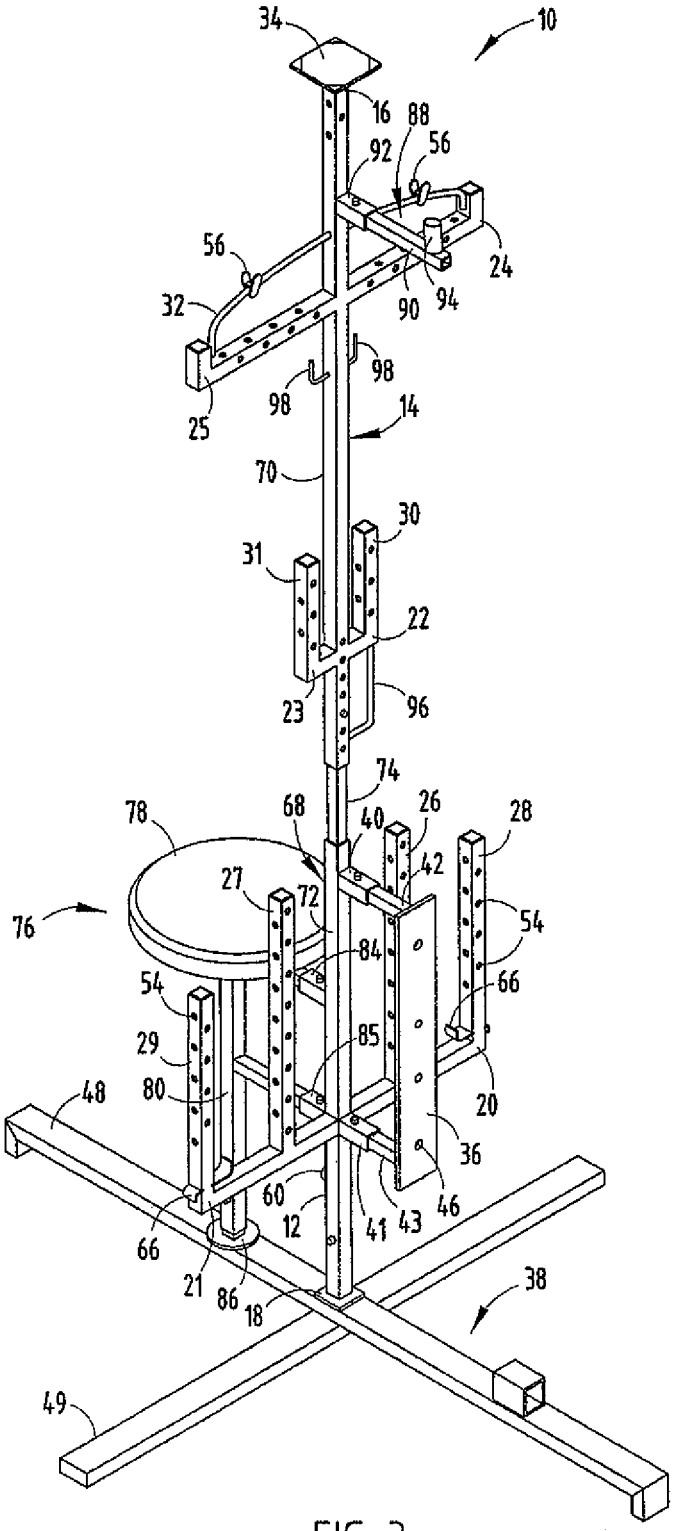
FIG. 3 is a rear perspective view of the sports equipment rack shown in FIG. 1.

As illustrated in FIG. 2, main vertical member 14 may be divided into separate telescoping sections, including a lower section 68 and an upper section 70. In the illustrated embodiment, lower sections 68 includes a larger diameter tubular section 70 and a smaller diameter tubular section 74, whereas upper section 70 of main vertical member 14 includes only a single larger diameter tubing which is the same size as the larger diameter tubing 72 of the lower section 68. The outer dimensions of small diameter section 74 correspond with the inner dimensions of the larger diameter tube of upper section 70 so that upper section 70 can slide up and down in a telescoping manner with respect to lower section 68, whereby the height of rack 10 may be adjusted. At the same time, the distance from hanger 32 to trouser leg restrainers 26, 27 is also adjusted to accommodate various trouser lengths to optimize utility during washing and drying. Various spring-loaded locking mechanisms may be used for holding upper section 70 at a desired height. The telescopic sections 68, 70 and height adjustment locking mechanisms are designed to maintain a substantially leak proof or leak resistant conduit for conveying air from blower 64 to apertures 54 regardless of the height adjustment.

A useful optional feature of the sports equipment rack 10 of the invention is the provision of a detachable stool 76. Stool 76 includes a padded seat 78, a vertical support member 80, and a pair of spaced apart lateral support members 82, 83 which connect with corresponding spaced apart lateral extensions 84, 85 projecting from a side of lower section 68 of main vertical member 14. Preferably extensions 84, 85 and lateral supports members 82, 83 are provided with cooperating quick-connect coupling mechanisms that allow stool 76 to be quickly and easily attached to vertical member 14 and detached from vertical member 14. A support plate 86, which may include a cushioned pad (e.g., a rubber pad) on its underside, rests on the upper surface of base member 48 of foldable base 38. Stool 76 is particularly useful for removing boots or other footwear, gear or clothing when rack 10 is used out of doors at a remote location.

Another attractive optional feature of the sports equipment rack of this invention is the provision of a detachable umbrella holder 88. Detachable umbrella holder 88 (best illustrated in FIG. 4A) includes a member 90 that is insertable into a lateral extension 92 projecting from main vertical member 14, and a socket or retainer cup 94 for receiving an umbrella pole 95 or umbrella handle. Member 90 and extension 92 are preferably provided with cooperative quick-connect/disconnect coupling features that allow the umbrella holder 88 to be quickly and easily attached to or removed from vertical member 14. This feature is particularly helpful for outdoor use during inclement weather, facilitating drying of clothing and/or equipment out of doors, even while it is raining.

In order to facilitate transportability, main vertical member is preferably provided with a handle 96.

Hooks 98 project outwardly from side walls of vertical member 14 to provide means for supporting various miscellaneous items.

While frame 12 may be constructed from various materials, including plastics, especially fiber reinforced plastics, hollow metal tubing, such as steel or aluminum is preferred. The various extensions and support members are preferably welded together, and plastic caps 99 may be used for closing off the ends of the various supports and extensions.

The sports equipment rack is typically used as indicated in FIG. 1. Trousers may be suspended from prongs 58 or hanger clips 56 attached to hanger 32. Preferably, trousers 50 are suspended from prongs 58 or clips 56 at the waist, so that the pant legs 51, 52 can be positioned over trouser leg retainers 26, 27. If cleaning is necessary, it may be desirable to spray wash the trousers before supporting other equipment and/or clothing on rack 10. Mittens or gloves 100 and/or boots 102 or other footwear may be placed over glove supports 30, 31 and footwear supports 28, 29 as appropriate, and spray washed as needed. Jersey or jacket 104 may then be draped over hanger 32 as shown in FIG. 1, and helmet 106 or other headgear may be placed on headgear support plate 34 and spray washed as needed. Thereafter, is desired, a blow dryer 64 may be connected to rack 10 via flexible hose 62 to dry equipment and clothing supported on rack 10. Of course, rack 10 may be used for cleaning without forced convection drying, for either forced convection drying or natural drying without washing, or only for supporting and/or storing equipment/clothing.

While the invention has been described primarily with reference to its use for cross country motorcycle racing equipment rack 10 may also be used for hunting equipment and/or clothing, snowmobile equipment and/or clothing, football equipment and/or clothing, and various other sporting equipment and/or clothing.

The above description is considered that of particular embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A sports equipment rack, comprising:

a frame including a main vertical member;

a hanger supported by the main vertical member for draping an article of clothing, the hanger having opposite ends on opposite sides of the main vertical member;

a pair of extensions projecting laterally from the main vertical member in opposite directions, each of the laterally projecting extensions positioned below a respective one of the ends of the hanger, the main vertical member and the pair of extensions comprising hollow metal tubing defining communicating conduit and each extension having a plurality of apertures to facilitate forced air flow through the conduit, wherein at least a portion of the apertures are oriented toward the hanger such that air flow exits out of at least a portion of the apertures onto an article supported on the hanger; and a blower in fluid communication with the conduit defined by the tubular members to force air outwardly through the apertures to dry an article supported on the hanger.

2. A sports equipment rack of claim 1, further comprising a pair of upwardly extending tubular members defining apertures to facilitate drying of trouser legs, wherein a first one of the upwardly extending tubular members is located underneath a first one of the hanger ends, and wherein a second one of the upwardly extending tubular members is located underneath a second one of the hanger ends.

3. The sports equipment rack of claim 2, wherein the pair of upwardly extending tubular members define a pair of hollow pant leg restrainers, shaped for insertion into bottom portions of pants supported on a trouser support on an upper section of the main vertical member to suppress movement of pant legs during spray washing, being in fluid communication with the conduit, and having apertures for emitting drying air from the conduit into an interior of pants.

4. The sports equipment rack of claim 3, wherein the main vertical member includes a telescopic section for adjusting a height of the rack.

5. The sports equipment rack of claim 3, wherein the main vertical member includes a telescopic section for adjusting a height of the rack.

6. The sports equipment rack of claim 1, in which the hanger is configured to support shoulders of an article of clothing, the hanger positioned in proximity to the apertures of the extensions to facilitate accelerated drying of the article of clothing on the hanger when air is blown through the conduit.

7. The sports equipment rack of claim 1, further comprising a pair of hollow boot extensions projecting laterally from a location adjacent a lower end of a lower section of the main vertical member in opposite directions and being in fluid communication with the conduit.

8. The sports equipment rack of claim 1, further comprising a pair of hollow glove extensions projecting laterally from a location adjacent a lower end of an upper section of the main vertical member in opposite directions and being in fluid communication with the conduit; and a pair of hollow glove supports extending upwardly from the glove extensions, each shaped for insertion into an interior of a glove to support the same thereon, being in fluid communication with the conduit, and having apertures for directing drying air from the conduit into interiors of gloves supported on the glove extensions.

9. A sports equipment rack, comprising:

an air blower;

a main vertical member having a lower section adjustably connected to an upper section in a telescopic manner, wherein the main vertical member defines at least one of: a leak-resistant conduit or a leak-proof conduit; and a plurality of horizontally members, extending from the main vertical member, that including apertures, wherein the main vertical member is configured to communicate air flow from the air blower to the apertures.

10. The sports equipment rack of claim 9, further comprising a foldable base for supporting the rack, wherein the foldable base is configured to connect and disconnect the lower section to the base to facilitate compact transportation and storage of the rack.

11. The sports equipment rack of claim 9, further comprising:

at least one valve mechanism to either limit air flow or prevent air flow through at least a portion of the apertures.

12. The sports equipment rack of claim 9, further comprising:

a hanger supported by the main vertical member, the hanger having opposite ends on opposite sides of the main vertical member; and a pair of extensions projecting laterally from the main vertical member in opposite directions, each of the laterally projecting extensions positioned are below a respective one of the ends of the hanger, the main vertical member and the pair of extensions comprising hollow metal tubing defining communicating conduit and each extension having a plurality of apertures to facilitate forced air flow through the conduit, wherein at least a portion of the apertures are oriented toward the hanger such that air flow exits out of at least a portion of the apertures onto an article supported on the hanger, wherein the air blower is in fluid communication with the main vertical member to force air outwardly through the apertures to dry an article supported on the hanger.

13. The sports equipment rack of claim 9, further comprising: a pair of upwardly extending tubular members defining apertures to facilitate drying of trouser legs, wherein a first one of the upwardly extending tubular members is located underneath a first one of the hanger ends, and wherein a second one of the upwardly extending tubular members is located underneath a second one of the hanger ends.

14. The sports equipment rack of claim 13, wherein the pair of upwardly extending tubular members define a pair of hollow pant leg restrainers, shaped for insertion into bottom portions of pants supported on a trouser support on an upper section of the main vertical member to suppress movement of pant legs during spray washing, being in fluid communication with the conduit, and having apertures for emitting drying air from the conduit into an interior of pants.

15. The sports equipment rack of claim 9, further comprising a pair of hollow boot extensions projecting from a location adjacent a lower end of a lower section of the main vertical member in opposite directions and being in fluid communication with the conduit.

* * * * *